US006457989B1

(12) United States Patent
Aoki et al.

(10) Patent No.: US 6,457,989 B1
(45) Date of Patent: Oct. 1, 2002

(54) BRANCH CONNECTING DEVICE

(75) Inventors: Tohru Aoki; Naomi Kisu, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 68 days.

(21) Appl. No.: 09/655,784

(22) Filed: Sep. 6, 2000

(30) Foreign Application Priority Data

Sep. 7, 1999 (JP) ..... 11-253315

(51) Int. Cl.[7] ..... H01R 4/24
(52) U.S. Cl. ..... 439/402
(58) Field of Search ..... 439/402, 403, 439/404

(56) References Cited

U.S. PATENT DOCUMENTS

| | | | | |
|---|---|---|---|---|
| 5,358,423 A | * | 10/1994 | Burkhard et al. | 439/402 |
| 5,501,605 A | * | 3/1996 | Ozaki et al. | 439/34 |
| 5,653,607 A | * | 8/1997 | Saka et al. | 439/402 |
| 5,718,599 A | * | 2/1998 | Ichikawa et al. | 439/404 |
| 5,820,404 A | * | 10/1998 | Chishima et al. | 439/417 |
| 6,027,362 A | * | 2/2000 | LaCroix | 439/404 |
| 6,299,472 B1 | * | 10/2001 | Beukes | 439/403 |
| 6,315,578 B1 | * | 11/2001 | Kasai et al. | 439/76.2 |

FOREIGN PATENT DOCUMENTS

| | | |
|---|---|---|
| JP | 2-30222 | 2/1990 |
| JP | 4-123071 | 11/1992 |
| JP | 10-312837 | 11/1998 |

* cited by examiner

*Primary Examiner*—Tulsidas Patel
*Assistant Examiner*—Thanh-Tam Le
(74) *Attorney, Agent, or Firm*—Finnegan, Henderson, Farabow, Garrett & Dunner, L.L.P.

(57) ABSTRACT

A branch connecting device 10 designed to form a branch circuit by disposing a plurality of crimp contacts 14, 17 at prescribed locations on a connecting device body 11, then by electrically wiring a plurality of electric wires 18, 18' crosswise in a lateral direction and a longitudinal direction of the connecting device body 11, and further by pressure-bonding a plurality of the electric wires 18, 18' to a plurality of the crimp contacts 14, 17, wherein odd-numbered wires 18 of a plurality of said electric wires 18, 18' in the lateral and longitudinal direction are electrically wired on a top surface 11*a* of the connecting device body 11 and then pressure-bonded to the prescribed crimp contacts 14, 17 disposed on said top surface 11*a*, and besides, even-numbered wires 18' of a plurality of electric wires 18, 18' in the lateral and longitudinal direction are also electrically wired on a bottom surface 11*b* of the connecting device body 11, and then pressure-bonded to the prescribed crimp contacts disposed on said bottom surface 11*b*.

10 Claims, 6 Drawing Sheets

BRANCH CONNECTING DEVICE

BACKGROUND OF THE INVENTION

1. Field of the Invention

This invention relates to an electric branch connecting device wherewith a plurality of lateral (X-directional, hereafter) electric wires and longitudinal (Y-directional, hereafter) electric wires nearly perpendicular to them are branch-connected to each other.

2. Description of the Related Art

There are those disclosed in Japanese Utility Model Provisional Publication No. 2-30222/1990 and No. 4-123071/1992, and in Japanese Patent Provisional Publication No. 10-312837/1998 as background art for branch connecting devices, wherewith lateral electric wires and longitudinal wires are branch-connected using this type of crimp contact.

FIG. 1 shows a branch connecting device 1 disclosed in Japanese Patent Provisional Publication No. 10-312837. The branch connecting device 1 consists of a middle case 2 with a plurality of stair-like contact surfaces formed on both a top and a bottom surface thereof, and an upper case 3 and a lower case 4 having each of a plurality of lap surfaces to be lapped on each contact surface of both top and bottom surfaces of the middle case 2.

A plurality of contact insert holes 2*a* for inserting crimp contacts 5 are formed on each contact surface of the middle case, and wire fixing slots 2*b* are also formed on each contact surface of the top surface of said middle case 2.

The same number of stair-like step portions as that of lap surfaces on the bottom surface thereof are formed on the top surface of the upper case 3, and wire insert holes 3*a* for inserting x-directional wires 7A are formed on a vertical wall of each said step portion. Besides, a contact insert recess, not shown in the Figure, is formed at a location, on each lap surface of the bottom surface of the upper case 3, opposing to each contact insert hole 2*a* of the middle case 2. Each of the contact insert recesses is channeled to each wire Insert hole 3*a*, and one end of an x-directional wire 7A is exposed in each said contact insert recess.

The same number of stair-like step portions as that of lap surfaces on the bottom surface thereof are formed on the bottom surface of the lower case 4, and wire insert holes, not shown in the Figure, for inserting x-directional wires 7B are formed on a vertical wall of each said step portion. Besides. a contact insert recess 4*b* is formed at a location, on each lap surface of the top surface of the lower case 4, opposing to each contact insert hole 2*a* of the middle case 2. Each of the contact insert recesses 4*b* is channeled to each said wire insert hole, and one end of an x-directional wire 7B is exposed in each said contact insert recess 4*b*.

A crimp contact 5 comprises a pair of middle crimp portions 5*a*, 5*a* for pressure-bonding a halfway portion of an electric wire 6 in the middle case 2, an upper crimp portion 5*b* for pressure bonding an end of an electric wire 7A in the uppercase 3, and a lower crimp portion 5*c* for pressure-bonding an end of an electric wire 7B in the lower case 4. Then, engaging crimp contacts 5 in contact insert holes 2*a* at prescribed locations where branch circuits of the middle case 2 must be connected, by means of lapping each lap surface on the bottom surface of the upper case 3 and each lap surface on the top surface of the lower case 4 onto each contact surface on both top and bottom surfaces of said middle case 2, electric wires 7A in the upper case 3 are pressure-bonded to upper crimp portions 5*b* of crimp contacts 5, and electric wires 75 in the lower case 4 are pressure-bonded to lower crimp portions 5*c* of crimp contacts 5, and accordingly x-directional wires 7A, 7B are branch-connected to Y-directional wire 6. Consequently, interference between each of the electric wires 7A in the upper case 3 and between each of the electric wires 7B in the lower case 4 is prevented.

However, with regard to said conventional branch connecting device 1. the size Z in vertical direction (height) has occurred to increase through lapping the upper case 3 and the lower case 4 on both top and bottom surfaces of the middle case 2 in order to branch-connect each electric wire 6, 7A, 7B, and a total size of the branch connecting device 1 has gotten larger consequently. Therefore, the branch connecting device 1 has been inferior in mountability at amounting area where it is equipped.

Besides, with regard to the branch connecting devices disclosed in Japanese Utility Model Provisional Publication No. 2-30222 and No. 4-123071, since the usable area for branch-connection is limited because of almost coplanar arrangement of X-directional plural wires and Y-directional plural wires, a broad area has become an unusable dead space and space has never been utilized efficiently.

SUMMARY OF THE INVENTION

The present invention was issued in order to solve the problems described above, and aims to provide a branch connecting device wherewith simplification and miniaturization of structure can be accomplished and further a number of various branch-connections can be easily done in a short time.

The invention described in claim 1 is a branch connecting device having a connecting device body having a top surface and a bottom surface, a plurality of crimp contacts disposed at prescribed locations of said connecting device body, and a plurality of electric wires being electrically wired crosswise each other in a lateral direction and a longitudinal direction of said connecting device body, wherein branch circuits is formed by pressure-bonding a plurality of said electric wires to a plurality of said crimp contacts, each of odd-numbered wires of a plurality of said electric wires are wired in the lateral and longitudinal direction on one of either top or bottom surface of said connecting device body, said odd-numbered wires are pressure-bonded to the prescribed crimp contacts disposed on said one surface, each of even-numbered wires of a plurality of said electric wires are electrically wired in the lateral and longitudinal direction on the other of either top or bottom surface of said connecting device body, and said even-numbered wires are pressure-bonded to the prescribed crimp contacts disposed on said other surface.

With regard to this branch connecting device, since a plurality of wires in a lateral and a longitudinal direction are electrically wired crosswise each other on both top and bottom surfaces of the connecting device body, and since each wire is made branch-connected by means of a crimp contact, therefore simplification and miniaturization of a total structure of the branch connecting device can be achieved. According to this fact, a number of various branch connections of electric wires are made probable, and the device contributes a great deal to space saving of a mounting area. Besides, each adjacent wire can maintain a clearance of one wire between each other, so that a mechanical or an electromagnetic interference between crimp contacts and wires as well as between crimp contacts can surely be avoided.

The invention described in claim 2 is a branch connecting device of claim 1, wherein each crimp contact disposed on both top and bottom surfaces of said connecting device body has respectively a pair of segments opposite to each other being formed into an approximately rectangular pipe-like structure, and a pair of said segments include approximately V-shaped crimp portions whose deepest positions are at least by the thickness of a wire different from those of adjacent segments, and the pair of crimp contacts almost opposite to each other on said top and bottom surfaces include link tabs or link terminals, and further the pair of said crimp contacts are detachable and also attachable at the same time (detachable/attachable, hereafter) by means of said link tabs and link terminals.

With regard to this branch connecting device, since crimp contacts having V-shaped crimp portions with the deepest positions, defined by at least the thickness of a wire, different from those of adjacent segments are disposed at the locations almost opposite to one another on both top and bottom surfaces of the connecting device body, and since these crimp contacts are detachable/attachable with one another by means of link tabs and link terminals, therefore a total of 4 wires consisting of 2 wires on the top surface and 2 wires on the bottom surface of the connecting device body can be easily branch-connected with a pair of crimp contacts, and duration of bonding them is shortened. Besides, as pressure bonding can be carried out keeping a pitch between each of adjacent wires constant, automation of branch-connecting operation is made probable.

DESCRIPTION OF THE PREFERRED EMBODIMENT

In the following, one embodiment of the present invention will be described according to the drawings.

Figure 1:
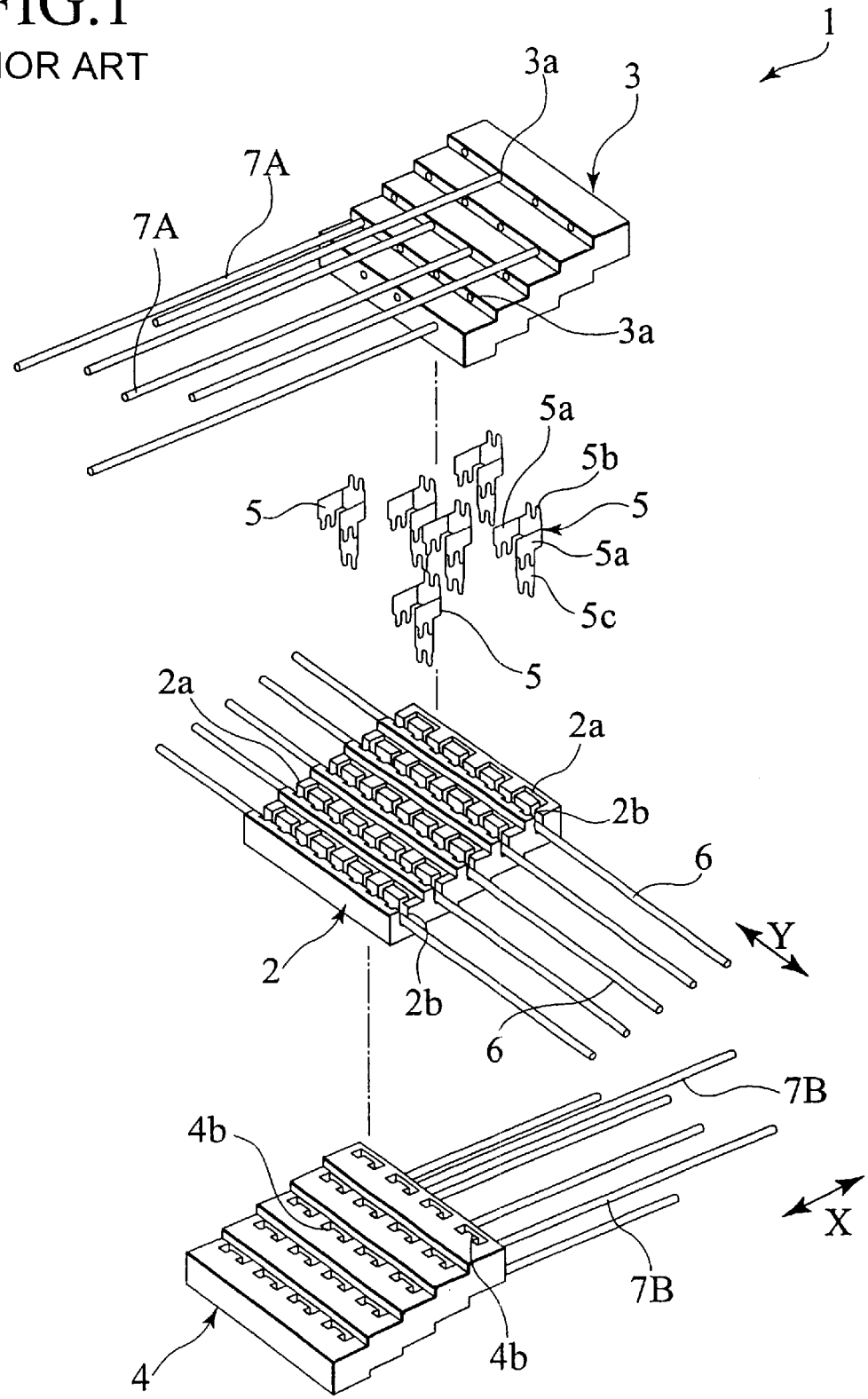
FIG.1 PRIOR ART
FIG. 1 is an exploded perspective view of a branch connecting device in accordance with the background art.
Figure 2:
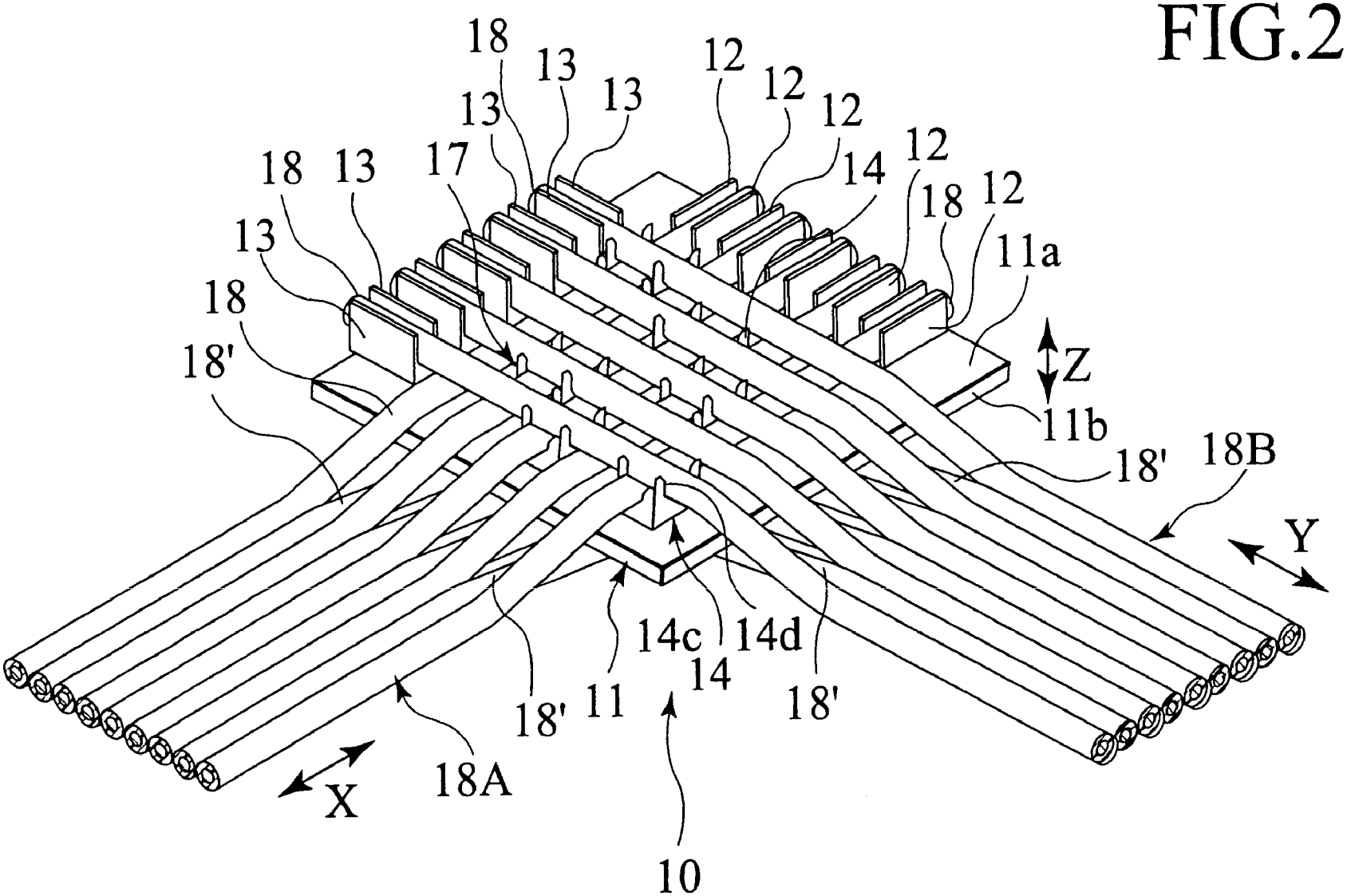
FIG. 2 is a perspective view of a branch connecting device in accordance with one embodiment of the present invention.

As shown in FIG. 2, a branch connecting device 10 has a connecting device body 11, as a base, made of a synthetic resin in the shape of a rectangular plate. Along a longitudinal (Y-directional) side and an adjacent lateral (X-directional) side perpendicular to the former on a top surface 11*a* and a bottom surface 11*b* of the connecting device 11, a plurality of protruding ribs (wire support portion) 12 and 13, wherewith unbonded separate wires 18, 18' of a flat fusion-bonded cable 18A arranged in X-direction and unbonded separate wires 18, 18' of a flat fusion-bonded cable 18B arranged in Y-direction are supported so as to pinch themselves, are formed protrusively as one piece at the same interval.

Odd-numbered wires 18 of separate electric wires 18, 18' of an X-directional fusion-bonded cable 18A are supported between a pair of ribs 12, 12 at predetermined positions of a top surface (one surface) 11*a* of a connecting device body 11 and are electrically wired on said top surface 11*a*, and on the other hand, odd-numbered wires 18 of separate electric wires 18, 18' of a Y-directional fusion-bonded cable 18B are supported between a pair of ribs 13, 13 at predetermined positions of a top surface 11*a* of a connecting device body 11 and are wired almost perpendicularly crosswise on each of odd-numbered wires 18 in X-direction, and they are both designed to be pressure-bonded to crimp contacts 14, 17 disposed, at predetermined positions to be described later, on the top surface 11*a* of the connecting device body 11.

Further, even-numbered wires 18 of separate electric wires 18, 18' of an X-directional fusion-bonded cable 18A are supported between a pair of ribs 12, 12 at prescribed position of a bottom surface (the other surface) 11*b* of the connecting device body 11 and are wired on said bottom surface 11*b*, and on the other hand, even-numbered wires 18 of separate electric wires 18, 18' of an Y-directional fusion-bonded cable 18B are supported between a pair of ribs 13, 13 at prescribed position of a bottom surface 11*b* of the connecting device body 11 and are wired almost perpendicularly crosswise on each of even-numbered separate wires 18 in X-direction, and they are both designed to be pressure-bonded to crimp contacts 15, 17 disposed. at prescribed positions to be described later, on the bottom surface 11*b* of the connecting device body 11. Further, in FIG. 3A and FIG. 4A, odd-numbered wires 18 of separate wires 18, 18' in X, Y-direction are shown by solid lines and even-numbered wires 18' of them are shown by phantom lines.

Since the present invention is characterized in alternately allotting separate electric wires onto both top and bottom surfaces of a connecting device body, it is obvious to those skilled in the art that another embodiment different from the one in FIG. 2 may be adopted, wherein, for example, odd-numbered wires 18 of an X-directional fusion-bonded cable and even-numbered wires 18' of a Y-directional fusion-bonded cable may be electrically wired on one same surface of the connecting device body, and even-numbered wires 18' of an X-directional fusion-bonded cable and odd-numbered wires 18 of a Y-directional fusion-bonded cable may be wired on the other same surface.

Figure 3A:
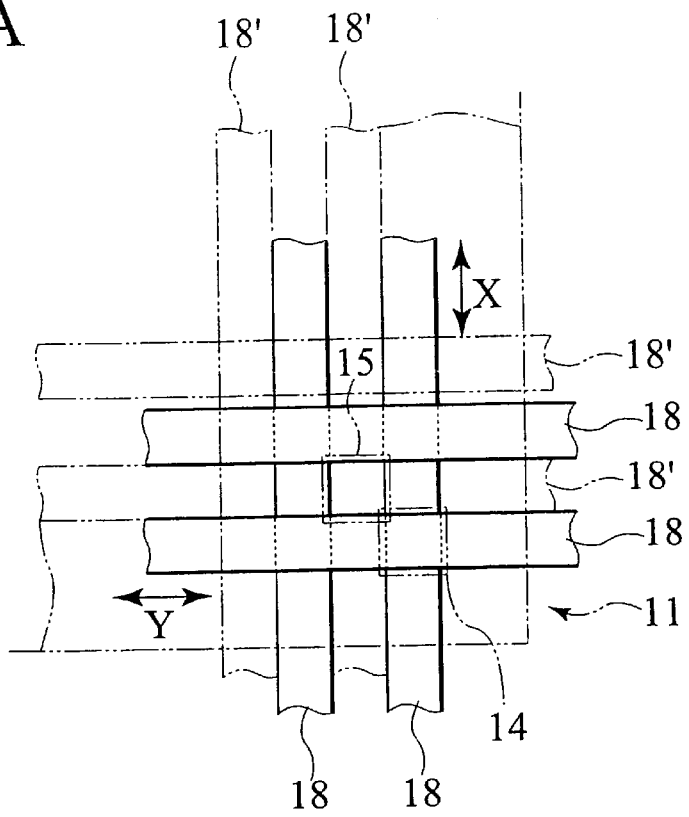
FIG. 3 is (A) a partial top view showing the relation between each of electric wires and each of crimp contacts on both top and bottom surfaces being used in a branch connecting device of the above mentioned embodiment, (B) a perspective view of each of crimp contacts of the same.

As shown in FIGS. 3A, B, a pair of crimp contacts 14, 15 disposed at an almost opposite position on top and bottom surfaces 11*a*, 11*b* of a connecting device body 11 are formed into almost rectangular-shaped pipes made of an electrically conductive metal. On a pair of opposing segments 14*a*, 14*a*, 14*b*, 14*b*, and 15*a*, 15*a*, 15*b*, 15*b* each of almost rectangular pipe-like crimp contacts 14, 15, slot-like (approximately V-shaped) blade edges (crimp portions) 14*c*, 14*d* and 15*c*, 15*d* having the deepest positions different at least by the thickness of a wire 18 (18') disposed thereto from those of adjacent segments 14*a*, 14*b* and 15*a*, 15*b*, are formed respectively. That is to say, a height, from a bottom portion of the crimp contact, of the deepest-position of each of crimp edges 14*c*, 15*c* is lower, at least by the thickness of one electric wire 18 (18') disposed at 14*a*, 14*a*, 15*a*, 15*a*, than that of the deepest-position of each of crimp edges, 14*d*, 15*d*, resulting in an deeper crimp portion.

And, a pair of both upper and lower crimp contacts 14 and 15, a part of each of corner portions of which is almost opposite to one another on top and bottom surfaces 11*a*, 11*b* of the connecting device body, is detachable/attachable by means of link members 14*e*, 16. That is to say, electric connection is achieved by means of a link tab 14*e* protrusively formed as one piece on one segment 14*a* of the upper crimp contact 14 and a link terminal 16 protrusively formed as one piece (maybe separately) on one segment 15*a* of the lower crimp contact 15. That is, these link tab 14*e* and link terminal 16 are designed to be linked together by insertion into a through-hole not shown in the FIGS. 3A,3B.

Besides, force fit tabs, 14*f*, 15*f* for force fitting a crimp contact to the connecting device body 11 are protrusively formed as one piece at the bottom end of each of segments 14*b*, 15*b* of each of crimp contacts 14, 15.

Figure 3B:
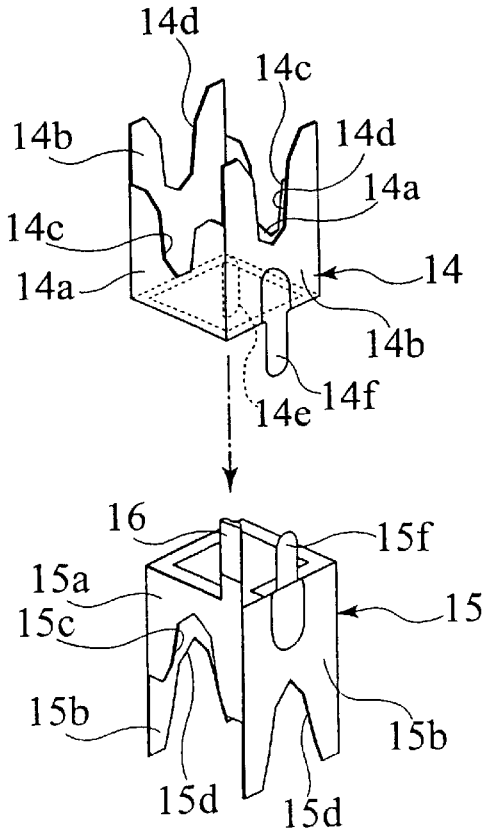
Figure 4A:
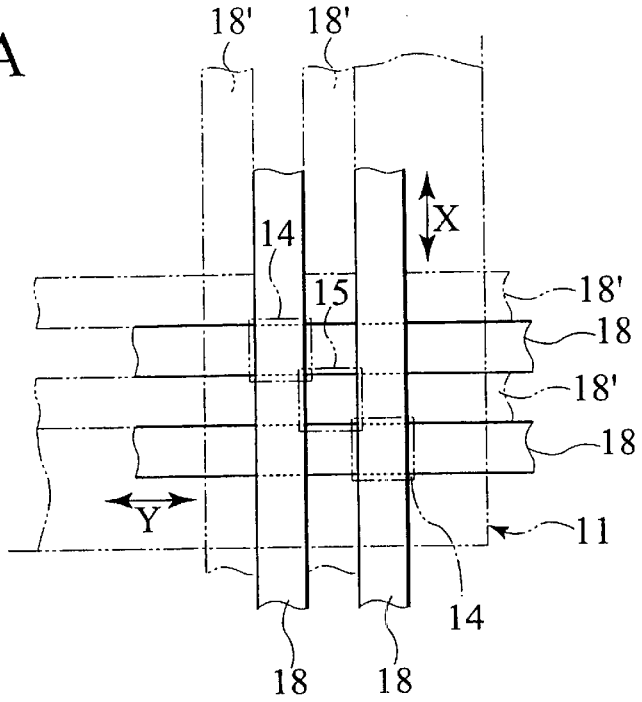
FIG. 4 is (A) a partial top view showing the relation between each of electric wires and each of crimp contacts on both top and bottom surfaces being used in a branch connecting device as one of variation of the preferred embodiment, (B) a perspective view of each of crimp contacts of the same.
Figure 4B:
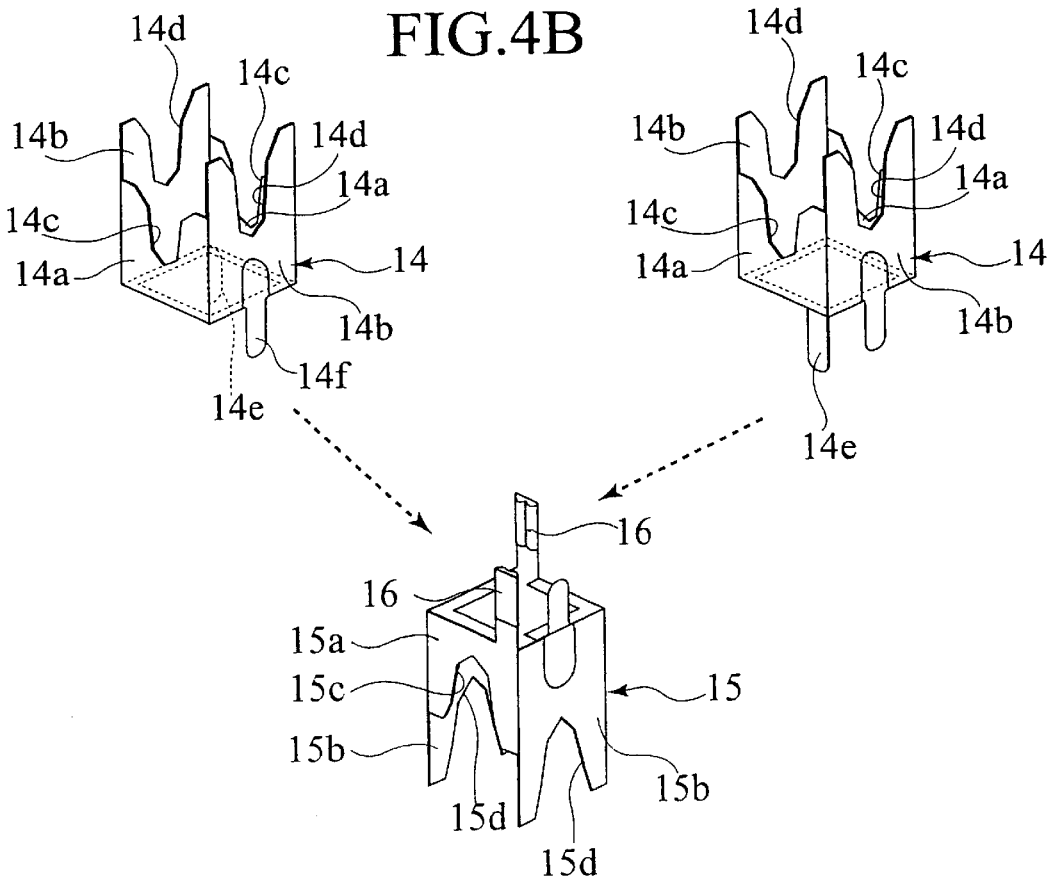

Crimp contacts 14, 15 wherein one link tab 148 or one link terminal 16 is formed respectively are shown in FIGS. 3A, 3B, one the other hand, those with a plurality of link members can be also utilized as an another embodiment. As shown in FIGS. 4A, 4B, when one upper crimp contact 14 having two link tabs and two lower crimp contact 15 having one link terminal are detachable/attachable with each other, electric connection of six electric wires at maximum can be accomplished at once in accordance with the embodiment, and the number of crimp contacts to be used can be further saved.

Figure 5A:
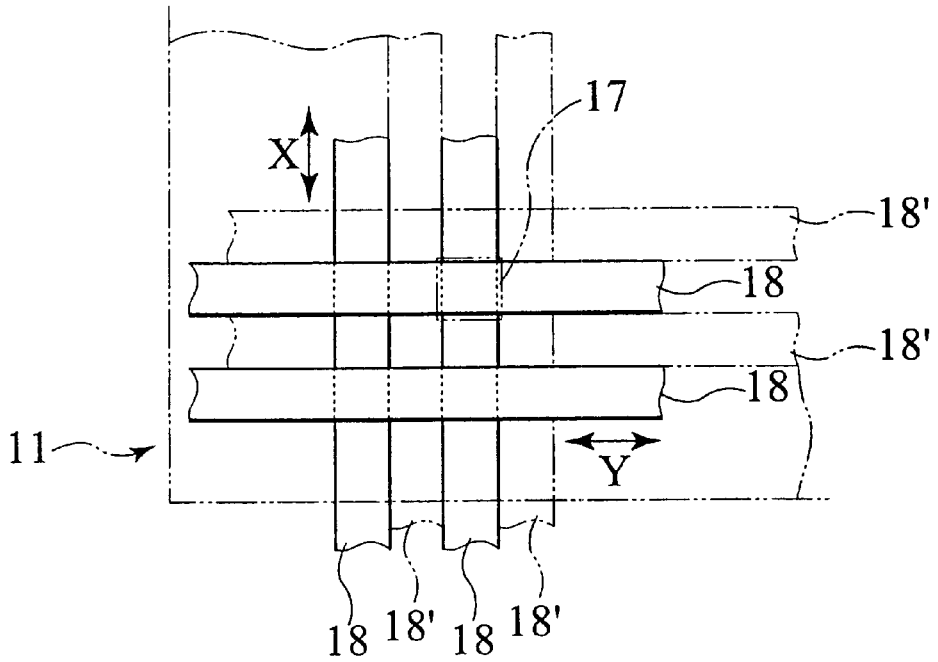
FIG. 5 is (A) a partial top view showing the relation between each of wires on both top and bottom surfaces and a crimp contact on a top surface being used in a branch connecting device of one embodiment, (B) a perspective view of the crimp contact of the same.
Figure 5B:
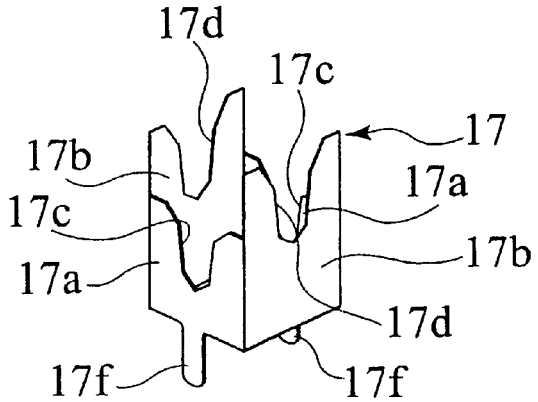

As shown in FIGS. 5A, 5B, a crimp contact 17 disposed at a prescribed location on a top surface 11*a* or a bottom surface 11*b* of a connecting device body 11 is formed into an approximately rectangular pipe made of an electrically conductive metal. On a pair of opposing segments 17*a*, 17*a*, 17*b*, 7*b* of the almost rectangular pipe like crimp contact 17, slot-like (approximately V-shaped) blade edges (crimp portions) 17*c*, 17*d* having deepest-positions, at least by the thickness of one wire 18 (18') disposed thereto, different from those of adjacent segments 17*a*, 17*b* are formed respectively. That is to say, the deepest-position of a crimp edge 17*c* is deeper at least by the thickness of one electric wire 18 (18') than the deepest-position of a crimp edge 17*d*. Besides. force fit tabs 17*f*, 17*f* for force fitting a crimp contact to the connecting device body 11 are protrusively formed as one piece at the bottom end of a pair of segments 17*a*, 17*a* of the crimp contact 17.

Figure 6:
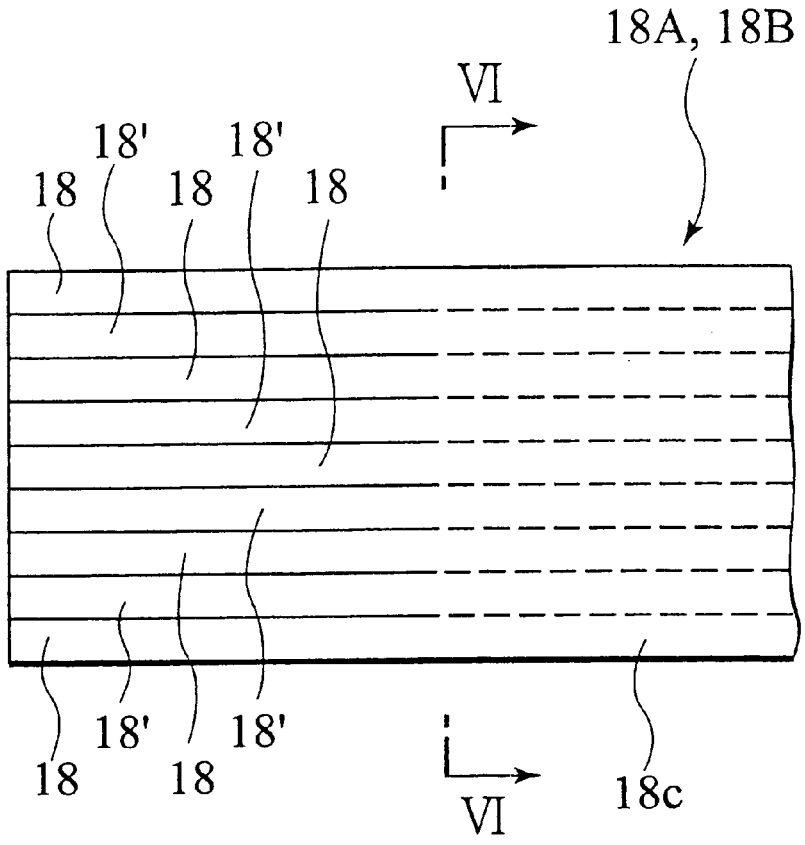
FIG. 6 is a partial top view of a plurality of flatly fusion-bonded wires used in a branch connecting device of one embodiment.
Figure 7:
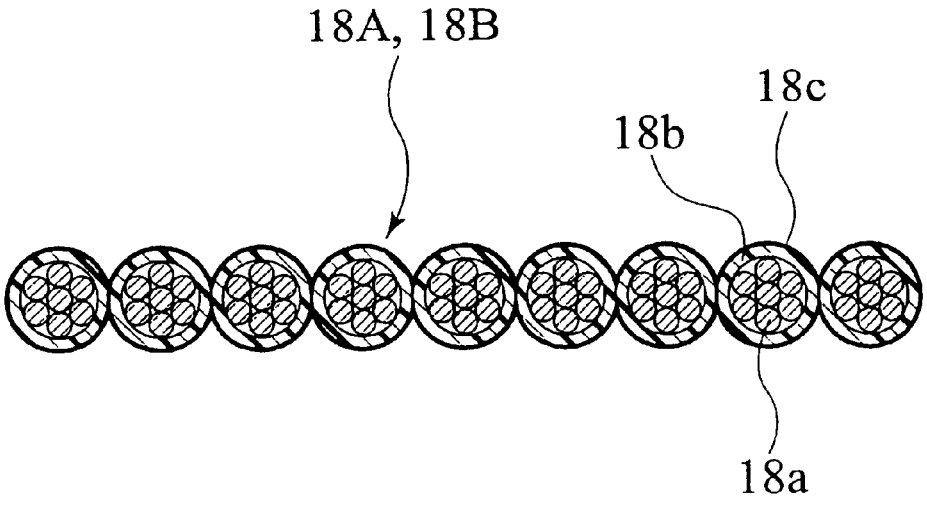
FIG. 7 is a sectional view along the line VI—VI in FIG. 6.

As shown in FIG. 6 and FIG. 7, each of flat fusion-bonded cables 18A, 18B arranged crosswise in X, Y directions respectively is formed into a flat shape, through coating an adhesive layer of a thermoplastic resin around an insulation coat 18B over each core wire 18*a* of each of electric wires 18, 18' with the same diameter, and through fusion-bonding each of adjacent wires 18, 18' together by heat pressing the portion not used for pressure-bonding of plural wires arranged in a parallel flat cable. Besides, an output connector or an electric equipment is designed to be connected to both ends of each of flat fusion-bonded wires 18, 18'.

According to a branch connecting device 10 of the above embodiment, in case of branch-connecting prescribed portions of a plurality of electric wires 18, 18', a plurality of crimp contacts 14, 15, 17 are disposed respectively at prescribed locations on top and bottom surfaces 11*a*, 11*b* of a connecting device body 11, and odd-numbered wires 18 of separate electric wires 18, 18' of an X-directional fusion-bonded cable 18A are supported between a pair of ribs 12, 12 at the prescribed position of the top surface 11*a* of the connecting device body 11 and are electrically wired on said top surface 11*a* and odd-numbered wires 18 of separate electric wires 18, 18' of a Y-directional fusion-bonded cable 18B are supported between a pair of ribs 13, 13 at the prescribed position of the top surface 11*a* of the connecting device body 11 and are wired almost perpendicularly crosswise on odd-numbered separate wires 18 in X-direction, and a prescribed position of each wire 18 is pressure-bonded to each of the upper crimp contacts 14, 17 disposed at the prescribed positions on the top surface 11*a* of the connecting device body 11 respectively.

Then, even-numbered wires 18 of separate electric wires 18, 18' of an X-directional fusion-bonded cable 18A are supported between a pair of ribs 12, 12 at the prescribed position of the bottom surface 11*b* of the connecting device body 11 and are wired on said bottom surface 11*b* and on the other hand, even-numbered wires 18 of separate electric wires 18, 18' of an Y-directional fusion-bonded cable 13B are supported between a pair of ribs 13, 13 at the prescribed position of the bottom surface 11*b* of the connecting device body 11 and are wired almost perpendicularly crosswise on even-numbered separate wires 18 in X-direction, and a prescribed position of each wire is pressure-bonded to each of the lower crimp contacts 15, 17 disposed at the prescribed positions on the bottom surface ilk of the connecting device body 11 respectively. By means-of these pressure-bonding processes, a number of desired branch circuits are produced.

As mentioned above, since a plurality of electric wires 18, 18' in X and Y direction are electrically wired crosswise each other on both top and bottom surfaces 11*a*, 11*b* of the connecting device body, and since each of wires 18, 18' is made branch-connected by means of each of crimp contacts 14, 15, 17 further simplification and miniaturization of a total structure of the branch connecting device 10 can be achieved through restraining a size of vertical direction (height direction) Z. According to this fact, a number of various branch-connections of electric wires 18, 18' are processed easily, and the device contributes a great deal to space saving of a mounting area. Besides, as shown in FIG. 3A, FIG. 5A, since a spacing between each of adjacent wire 18, and 18', 18' can maintain a clearance of one wire between each other, interference between crimp contacts 14 (15, 17) and wires 18 (18') as well as between crimp contacts 14, 14 (15, 17 and 15, 17) can surely be avoided.

Besides, as shown in FIGS. 3A, B, a pair of upper and lower crimp contacts 14, 15, in which blade edges 14*c*, 14*d* and 15*c*, 15*d* having the deepest-positions at least by the thickness of one wire different from those of adjacent segments 14*a*, 14*b* are formed, are disposed at the prescribed locations almost opposite to one another on top and bottom surfaces 11*a*, 11*b* of the connecting device body 11, and a pair of the upper and lower crimp contacts 14, 15 are detachable/attachable with one another by means of connecting tabs 14*e*, and relay-terminals 16. According to this fact, a total of 4 wires 18, 18, 18', 18' consisting of 2 wires 18, 18 on the top surface 11*a* and 2 wires 18' 18' on the bottom surface 11*b* of the connecting device body 11 can be easily branch-connected, and duration of bonding them is shortened. Besides, as pressure-bonding can be carried out at enough pitch between each of adjacent wires 18, 18 (18', 18'), automation of branch-connecting operation can be easily made.

Further, as shown in FIGS. 5A, 5B, since a crimp contact 17, in which blade edges 17*c*, 17*d* having the deepest-positions at least by the thickness of one wire different from those of the adjacent segments 17*a*, 17*b* are formed, are disposed at the prescribed locations on the top surface 11*a* or the bottom surface 11*b* of the connecting device body 11, two wires 18, 18 (18', 18') on the top surface 11*a* and two wires 18, 18 (18', 18') on the bottom surface 11*b* of the connecting device body 11 can be easily branch-connected, and duration of bonding them is shortened.

Although the case where sizes of electric wires are the same (the same diameter) is described according to said embodiment, it is obvious that said embodiment can be applied to a case where sizes of wires are different, because each of blade edges 14*c* or 14*d* in each direction of a crimp contact 14 can pressure-bond a wire independently of the other as shown in FIG. 2 or FIG. 3B. The case is the same as other crimp contacts 15, 17. Generally, where various electric wires of different sizes are used at the same time, because of difference of sizes of crimp contacts between a wire with a small diameter and that with larger one, adjacent disposition of crimp contacts of different sizes is likely to cause a mechanical or an electromagnetic interference with themselves and with adjacent wires. By virtue of the present embodiment, however, such interference is suppressed because of a clearance of one electric wire at both sides of a wire, and a crimp contact for an electric wire of a large diameter can be equipped.

Moreover, an electric wire used in the invention is not limited to a flat fusion-bonded cable, and it is obvious that a so-called ribbon wire or wholly separated wire may be adopted.

As described above, according to the invention of claim 1, since a plurality of wires in a lateral and a longitudinal direction are electrically wired crosswise each other on both top and bottom surfaces of a connecting device body. and since each wire is made branch-connected by means of a crimp contact, simplification and miniaturization of a total structure of the branch connecting device can be achieved.

By virtue of the invention of claim 1, a number of branch-connections of electric wires can be processed easily, and further the device contributes a great deal to space saving of a mounting area. Besides, since a plurality of electric wires arranged crosswise with one another are electrically wired allotting alternately odd-numbered wires and even-numbered ones onto different surfaces of a connecting device body, each adjacent wire can resultantly maintain a clearance of one wire between each other, and interference between crimp contacts and wires as well as between crimp contacts can surely be avoided.

According to the invention described in claim 2, since crimp contacts. V-shaped cramp portions having deepest-positions at least by the thickness of a wire different from those of adjacent segments are formed therein, are disposed at the locations opposite to one another on top and bottom surfaces of a connecting device body, and since these crimp contacts are detachable/attachable with one another by means of link tabs and link terminals, the number of crimp contacts can be saved, and a total of 4 wires consisting of 2 wires on the top surface and 2 wires on the bottom surface of the connecting device body can be easily branch-connected with a pair of crimp contacts. and duration of bonding them can be shortened, and additionally contribution to cost saving is also achieved. Besides, as pressure-bonding can be carried out at enough pitch between each of adjacent wires, automation of branch-connecting operation can be easily achieved.

What is claimed is:

1. A branch connecting device, comprising:

a connecting device body having a top surface and a bottom surface;

a plurality of crimp contacts disposed at predetermined locations of said connecting device body; and a plurality of electric wires being electrically wired crosswise each other in a lateral direction and a longitudinal direction of said connecting device body;

wherein branch circuits are formed by pressure-bonding said plurality of electric wires onto said plurality of crimp contacts;

each of odd-numbered wires of said plurality of said electric wires are wired in the lateral and longitudinal direction on one of said top or bottom surfaces of said connecting device body;

said odd-numbered wires are pressure-bonded to predetermined crimp contacts of said plurality of crimp contacts disposed on said one of said top or bottom surfaces;

each of even-numbered wires of said plurality of electric wires are electrically wired in the lateral and longitudinal direction on the other of said top or bottom surfaces of said connecting device body; and said even-numbered wires are pressure-bonded to predetermined crimp contacts of said plurality of crimp contacts disposed on said top or bottom surfaces.

2. The branch connecting device of claim 1, wherein said plurality of electric wires are wires of flat fusion-bonded cables.

3. The branch connecting device of claim 1, wherein each wire of said plurality of electric wires has a different diameter.

4. A branch connecting device, comprising:

a connecting device body having a top surface and a bottom surface;

a plurality of crimp contacts disposed at prescribed locations of said connecting device body; and a plurality of electric wires being electrically wired crosswise each other in a lateral direction and a longitudinal direction of said connecting device body;

wherein branch circuits are formed by pressure-bonding said plurality of electric wires to said plurality of crimp contacts;

each of odd-numbered wires of said plurality of electric wires are wired in the lateral and longitudinal direction on one of said top or bottom surfaces of said connecting device body;

said odd-numbered wires are pressure-bonded to first prescribed crimp contacts of said plurality of crimp contacts disposed on said one of said top or bottom surfaces;

each of even-numbered wires of said plurality of electric wires are electrically wired in the lateral and longitudinal direction on the other of said top or bottom surfaces of said connecting device body;

said even-numbered wires are pressure-bonded to second prescribed crimp contacts of said plurality of crimp contacts disposed on said other of said top or bottom surfaces; and each of said first and said second prescribed crimp contacts disposed on said top surface and said bottom surface of said connecting device body is formed in an approximately rectangular pipe-like shape, having a pair of segments opposite to each other, wherein each segment of said pair of segments includes a crimp portion.

5. The branch connecting device of claim 4, wherein each segment of said pair of segments includes an approximately V-shaped crimp portion.

6. The branch connecting device of claim 4, wherein a position of a deepest-portion of each segment of said pair of segments is different at least by a thickness of one electric wire from a position of a deepest-portion of each adjacent segment.

7. The branch connecting device of claim 4, wherein each segment of said pair of segments has a deepest-portion with a depth different from that of a depth of a deepest-portion of each segment adjacent to said pair of segments, and the difference of said depths of said deepest-portions is defined at least by a thickness of an electric wire which is disposed on each segment of said pair of segments having deeper deepest-portions.

8. The branch connecting device of claim 4, further comprising a pair of crimp contacts of said plurality of crimp contacts disposed at locations almost opposite to one another on said top and said bottom surface of said connecting device body, having a link tab or a link terminal, wherein said pair of said crimp contacts are detachable/attachable by means of said link tab or link terminal.

9. The branch connecting device of claim 4, further comprising a pair of crimp contacts of said plurality of crimp contacts disposed at locations almost opposite to one another on said top and said bottom surfaces of said connecting device body, each crimp contact of said pair of crimp contacts having at least one link member, wherein said pair of crimp contacts are detachable/attachable by means of the at least one link member.

10. The branch connecting device of claim 4, further comprising;

a first crimp contact of said plurality of crimp contacts having at least two link members on said one of said top and said bottom surfaces of said connecting device body; and a second crimp contact and a third crimp contact of said plurality of crimp contacts having at least one link member respectively on the other of said top and bottom surfaces of said connecting device body;

wherein each of said second and third crimp contacts are disposed almost opposite to said first crimp contact by means of said connecting device body interposed therebetween, and said first, said second and said third crimp contacts are detachable/attachable to one another by means of the link members.

* * * * *